US006551217B2

(12) United States Patent
Kaganovsky

(10) Patent No.: US 6,551,217 B2
(45) Date of Patent: Apr. 22, 2003

(54) COMBINATION EXERCISE APPARATUS

(76) Inventor: Yuriy Kaganovsky, 5523 Hermitage Ave., Los Angeles, CA (US) 91607

( * ) Notice: Subject to any disclaimer, the term of this patent is extended or adjusted under 35 U.S.C. 154(b) by 0 days.

(21) Appl. No.: 09/901,758

(22) Filed: Jul. 10, 2001

(65) Prior Publication Data

US 2003/0013581 A1 Jan. 16, 2003

(51) Int. Cl.[7] ..... A63B 69/16; A63B 22/04
(52) U.S. Cl. ..... 482/51; 482/57; 482/70
(58) Field of Search ..... 482/51, 52, 53, 482/57, 70, 71, 79, 80

(56) References Cited

U.S. PATENT DOCUMENTS 5,916,065 A * 6/1999 McBride et al. ..... 482/57
5,928,114 A * 7/1999 Chen ..... 482/57
5,961,423 A * 10/1999 Sellers ..... 482/57
6,171,217 B1 * 1/2001 Cutler ..... 482/70
6,238,321 B1 * 5/2001 Arnold et al. ..... 482/52

* cited by examiner

*Primary Examiner*—Stephen R. Crow
(74) *Attorney, Agent, or Firm*—Goldstein & Lavas, P.C.

(57) ABSTRACT

A combination exercise apparatus including a pair of base slats which are positionable on a recipient surface. The base slats are securable underneath an exercise cycle secured thereto. The pair of tracks are coupled with the pair of base slats opposed from the exercise cycle. The pair of tracks each have a lower end pivotally coupled with the base slats. Each of the tracks have a tread extending upwardly therefrom. A pair of skis extend between the exercise cycle and the pair of tracks. The pair of skis have inner ends and outer ends. The inner ends are coupled with the pair of pedals of the exercise cycle. The outer ends have wheels extending outwardly therefrom. The wheels slidably couple with the treads of the pair of tracks.

4 Claims, 3 Drawing Sheets

COMBINATION EXERCISE APPARATUS

BACKGROUND OF THE INVENTION

The present invention relates to a combination exercise apparatus and more particularly pertains to combining the functions of an exercise bicycle with an elliptical strider.

The use of exercise devices is known in the prior art. More specifically, exercise devices heretofore devised and utilized for the purpose of allowing people to exercise are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,762,317 to Camfield discloses an exercise device comprised of a combination exercise cycle and rowing machine with the handlebars serving a dual purpose. U.S. Pat. No. 5,335,188 to Brisson discloses a computer device for use with an exercise bicycle for monitoring various performance parameters. U.S. Pat. No. 5,356,356 to Hildebrandt discloses a device capable of providing exercise to the entire body.

While these devices fulfill their respective, particular objective and requirements, the aforementioned patents do not describe a combination exercise apparatus for combining the functions of an exercise bicycle with an elliptical strider.

In this respect, the combination exercise apparatus according to the present invention substantially departs from the conventional concepts and designs of the prior art, and in doing so provides an apparatus primarily developed for the purpose of combining the functions of an exercise bicycle with an elliptical strider.

Therefore, it can be appreciated that there exists a continuing need for a new and improved combination exercise apparatus which can be used for combining the functions of an exercise bicycle with an elliptical strider. In this regard, the present invention substantially fulfills this need.

SUMMARY OF THE INVENTION

In the view of the foregoing disadvantages inherent in the known types of exercise devices now present in the prior art, the present invention provides an improved combination exercise apparatus. As such, the general purpose of the present invention, which will be described subsequently in greater detail, is to provide a new and improved combination exercise apparatus which has all the advantages of the prior art and none of the disadvantages.

To attain this, the present invention essentially comprises an exercise cycle including a seat portion, a handle portion, a computer display, a base, and a pair of pedals. A pair of base slats are positionable on a recipient surface. The base slats have the base of the exercise cycle secured thereto. The pair of tracks are coupled with the pair of base slats opposed from the exercise cycle. The pair of tracks each have a lower end pivotally coupled with the base slats. Each of the tracks have a tread extending upwardly therefrom. A pair of jacks are secured to the pair of tracks. The pair of jacks are coupled with the pair of tracks for adjusting an angle of the tracks with respect to the pair of base slats. A handle member extends upwardly from the pair of tracks opposed from the exercise cycle. A pair of skis extend between the exercise cycle and the pair of tracks. The pair of skis have inner ends and outer ends. The inner ends are coupled with the pair of pedals of the exercise cycle. The outer ends have wheels extending outwardly therefrom. The wheels slidably couple with the treads of the pair of tracks. Each of the skis have a foot pad secured thereto.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved combination exercise apparatus which has all the advantages of the prior art exercise devices and none of the disadvantages.

It is another object of the present invention to provide a new and improved combination exercise apparatus which may be easily and efficiently manufactured and marketed.

It is a further object of the present invention to provide a new and improved combination exercise apparatus which is of durable and reliable construction.

An even further object of the present invention is to provide a new and improved combination exercise apparatus which is susceptible of a low cost of manufacture with regard to both materials and labor, and which accordingly is then susceptible of low prices of sale to the consuming public, thereby making such a combination exercise apparatus economically available to the buying public.

Even still another object of the present invention is to provide a new and improved combination exercise apparatus for combining the functions of an exercise bicycle with an elliptical strider.

Lastly, it is an object of the present invention to provide a new and improved combination exercise apparatus including a pair of base slats which are positionable on a recipient surface. The base slats are securable underneath an exercise cycle secured thereto. The pair of tracks are coupled with the pair of base slats opposed from the exercise cycle. The pair of tracks each have a lower end pivotally coupled with the base slats. Each of the tracks have a tread extending upwardly therefrom. A pair of skis extend between the exercise cycle and the pair of tracks. The pair of skis have inner ends and outer ends. The inner ends are coupled with the pair of pedals of the exercise cycle. The outer ends have wheels extending outwardly therefrom. The wheels slidably couple with the treads of the pair of tracks.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENTS

Figure 1:
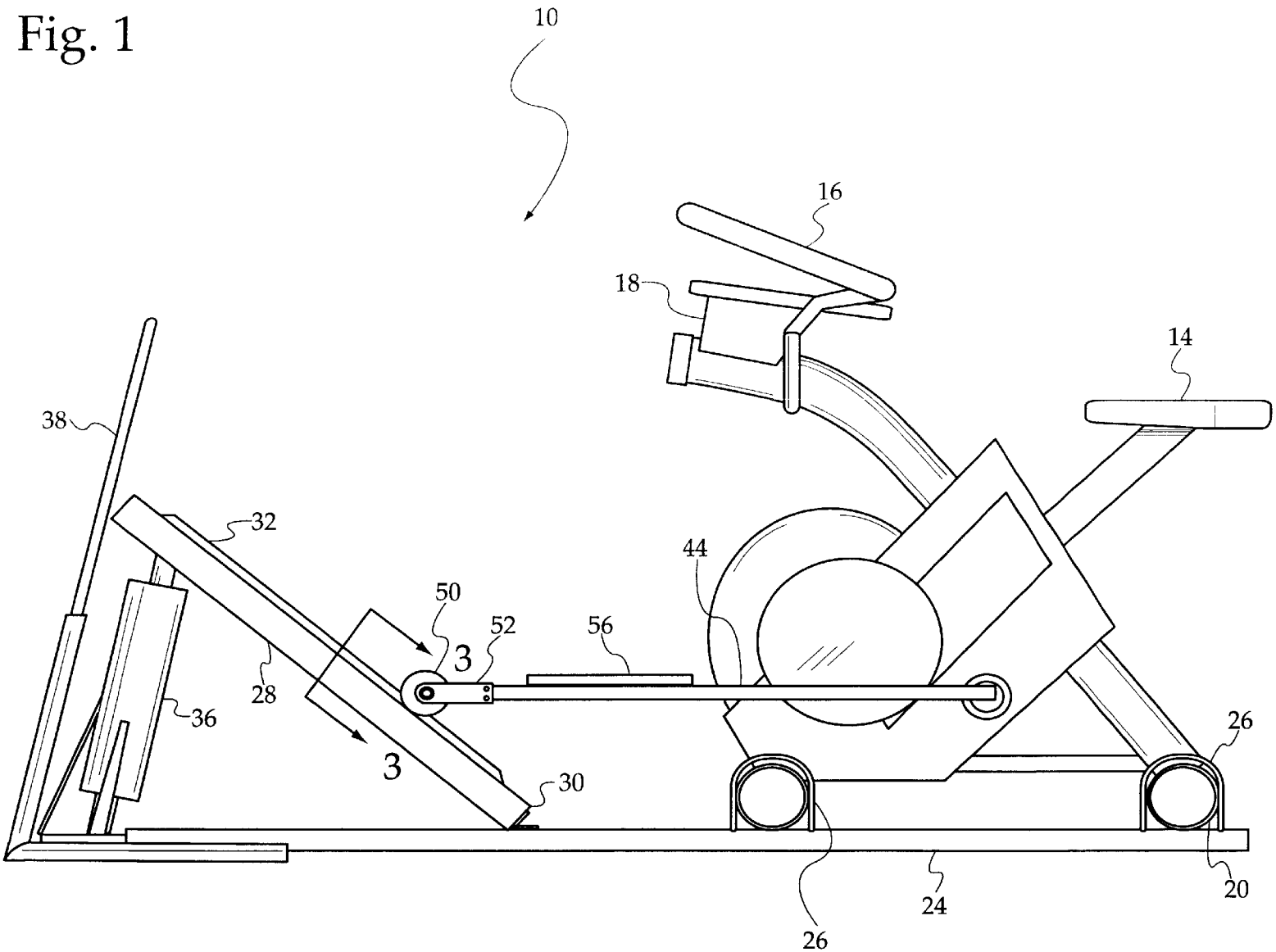
FIG. 1 is a side elevation view of the present invention.
Figure 2:
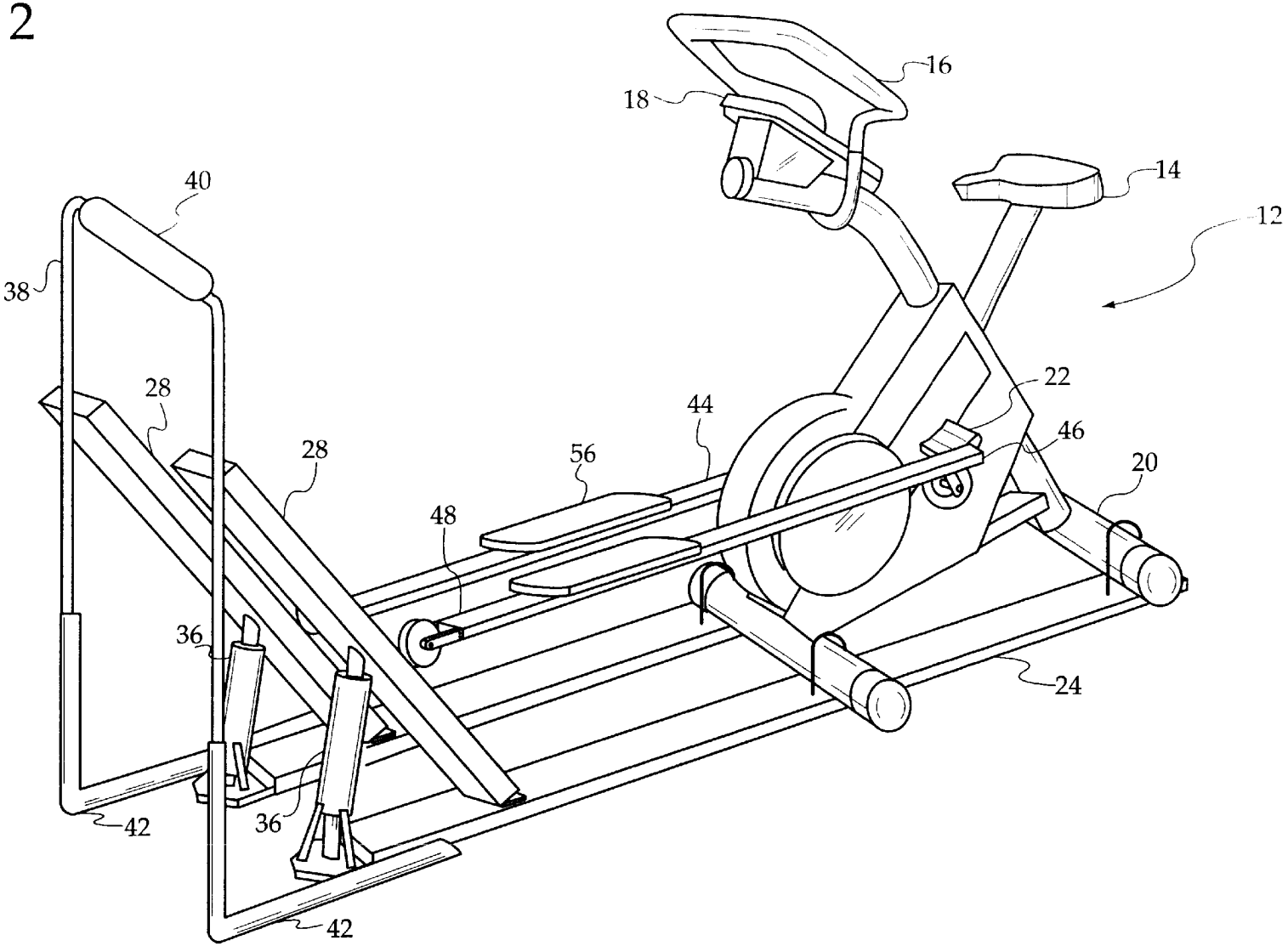
FIG. 2 is a perspective view of the preferred embodiment of the combination exercise apparatus constructed in accordance with the principles of the present invention.
Figure 3:
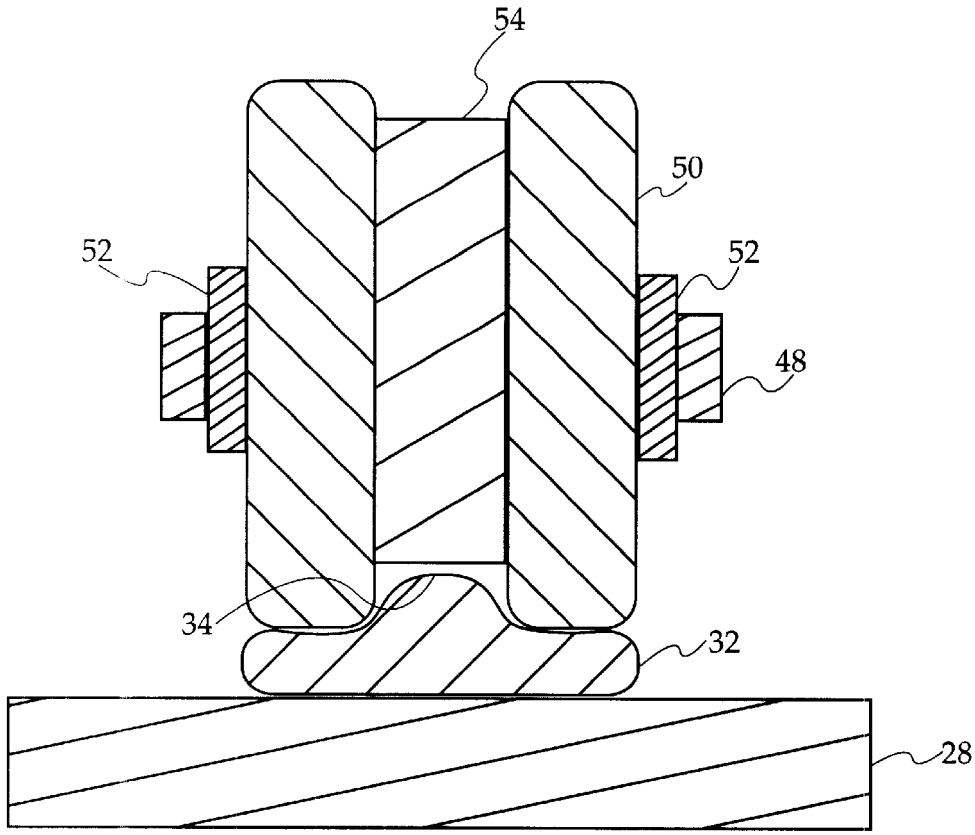
FIG. 3 is a cross-sectional view of the slide track of the present invention.

With reference now to the drawings, and in particular, to FIGS. 1 through 3 thereof, the preferred embodiment of the new and improved combination exercise apparatus embodying the principles and concepts of the present invention and generally designated by the reference number 10 will be described.

Specifically, it will be noted in the various Figures that the device relates to a combination exercise apparatus for combining the functions of an exercise bicycle with an elliptical strider. In its broadest context, the device consists of an exercise cycle, a pair of base slats, a pair of tracks, a pair of jacks, a handle member, and a pair of skis. Such components are individually configured and correlated with respect to each other so as to attain the desired objective.

The exercise cycle 12 includes a seat portion 14, a handle portion 16, a computer display 18, a base 20, and a pair of pedals 22.

The pair of base slats 24 are positionable on a recipient surface. The base slats 24 have the base 20 of the exercise cycle 12 secured thereto. As noted in FIGS. 1 and 2, inverted U-shaped clamps 26 secure the base 20 to the base slats 24.

The pair of tracks 28 are coupled with the pair of base slats 24 opposed from the exercise cycle 12. The pair of tracks 28 each have a lower end 30 pivotally coupled with the base slats 24. The pivotal coupling of the track's 28 with the base slats 24 enable the angle of between the track's 28 and the base slats 24 to be changed as needed. Each of the track's 28 have a tread 32 extending upwardly therefrom. The tread 32 is defined by a raised central section 34. Note FIG. 3.

The pair of jacks 36 are secured to the pair of base slats 24 adjacent to the pair of tracks 28. The pair of jacks 36 are coupled with the pair of tracks 28 for adjusting the angle of the tracks 28 with respect to the pair of base slats 24.

The handle member 38 extends upwardly from the pair of tracks 28 opposed from the exercise cycle 12. The handle member 38 utilized in the preferred embodiment, has a generally inverted U-shaped configuration defining an upper padded horizontal gripping member 40 with a pair of lower legs 42 extend inwardly to secure to the base slats 24.

The pair of skis 44 extend between the exercise cycle 12 and the pair of tracks 28. The pair of skis 44 have inner ends 46 and outer ends 48. The inner ends 46 are coupled with the pair of pedals 22 of the exercise cycle 12. The outer ends 48 have wheels 50 extending outwardly therefrom. The wheels 50 are each positioned between two braces 52 that extend linearly from the outer ends 48. The wheels 50 slidably couple with the treads 32 of the pair of tracks 28. More specifically, the wheels 50 each have a recessed central section 54 that is positioned on the raised central section 34 of the tread 32. Note FIG. 3. Each of the ski's 44 have a foot pad 56 secured thereto. The foot pad 56 allows a user to position their foot thereon to operate the ski's 44.

In use the pair of skis 44 will slide up and down the treads 32 of the track's 28 and utilize the cyclical motion of the pedals 22 of the exercise cycle 12 to achieve the motion normally associate with an elliptical strider.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A combination exercise apparatus for combining the functions of an exercise bicycle with an elliptical strider comprising, in combination:

an exercise cycle including a seat portion, a handle portion, a computer display, a base, and a pair of pedals;

a pair of base slats positionable on a recipient surface, the base slats having the base of the exercise cycle secured thereto;

a pair of tracks coupled with the pair of base slats opposed from the exercise cycle, the pair of tracks each having a lower end pivotally coupled with the base slats, each of the tracks having a tread extending upwardly therefrom;

a pair of jacks secured to the pair of base slats adjacent to the pair of tracks, the pair of jacks being coupled with the pair of tracks for adjusting an angle of the tracks with respect to the pair of base slats;

a handle member extending upwardly from the pair of tracks opposed from the exercise cycle; and a pair of skis extending between the exercise cycle and the pair of tracks, the pair of skis having inner ends and outer ends, the inner ends being coupled with the pair of pedals of the exercise cycle, the outer ends having wheels extending outwardly therefrom, the wheels slidably coupling with the treads of the pair of tracks, each of the skis having a foot pad secured thereto.

2. A combination exercise apparatus for combining the functions of an exercise bicycle with an elliptical strider comprising, in combination:

a pair of base slats positionable on a recipient surface, the base slats being securable underneath an exercise cycle secured thereto;

a pair of tracks coupled with the pair of base slats opposed from the exercise cycle, the pair of tracks each having a lower end pivotally coupled with the base slats, each of the tracks having a tread extending upwardly therefrom;

a pair of skis extending between the exercise cycle and the pair of tracks, the pair of skis having inner ends and outer ends, the inner ends being coupled with a pair of pedals of the exercise cycle, the outer ends having wheels extending outwardly therefrom, the wheels slidably coupling with the treads of the pair of tracks; and a handle member extending upwardly from the pair of tracks opposed from the exercise cycle.

3. The combination exercise apparatus as set forth in claim 2, and further including a pair of jacks secured to the pair of base slats adjacent to the pair of tracks, the pair of jacks being coupled with the pair of tracks for adjusting an angle of the tracks with respect to the pair of base slats.

4. The combination exercise apparatus as set forth in claim 2, wherein each of the skis have a foot pad secured thereto.

* * * * *